US009580879B1

(12) United States Patent
Williams

(10) Patent No.: US 9,580,879 B1
(45) Date of Patent: Feb. 28, 2017

(54) REMOTELY-OPERABLE RECIPROCATING COMPACTOR

(71) Applicant: Jason A. Williams, Raleigh, NC (US)

(72) Inventor: Jason A. Williams, Raleigh, NC (US)

( * ) Notice: Subject to any disclaimer, the term of this patent is extended or adjusted under 35 U.S.C. 154(b) by 0 days.

(21) Appl. No.: 15/144,103

(22) Filed: May 2, 2016

(51) Int. Cl.

| | |
|---|---|
| ***E02D 3/00*** | (2006.01) |
| ***E02D 3/074*** | (2006.01) |
| ***E02D 3/046*** | (2006.01) |
| ***E01C 19/32*** | (2006.01) |
| ***E01C 19/35*** | (2006.01) |

(52) U.S. Cl.
CPC ..... *E02D 3/074* (2013.01); *E01C 19/32* (2013.01); *E01C 19/35* (2013.01); *E02D 3/046* (2013.01)

(58) Field of Classification Search
CPC ..... E02D 3/046; E02D 3/074; E01C 19/32; E01C 19/35
USPC ..... 404/133.05
See application file for complete search history.

(56) References Cited

U.S. PATENT DOCUMENTS

| | | | | |
|---|---|---|---|---|
| 2,659,281 | A * | 11/1953 | Lucas | E01C 19/238 404/133.1 |
| 4,779,418 | A | 10/1988 | Artzberger | |
| 5,754,023 | A | 5/1998 | Roston et al. | |
| 6,000,879 | A | 12/1999 | Greppmair | |
| 6,285,925 | B1 | 9/2001 | Steffen | |
| 6,302,622 | B1 | 10/2001 | Nagasawa | |
| 6,390,034 | B1 | 5/2002 | Orzal et al. | |
| 6,443,651 | B1 | 9/2002 | Greppmair | |
| 6,749,365 | B2 | 6/2004 | Sina et al. | |
| 7,354,221 | B2 | 4/2008 | Congdon | |
| 7,491,014 | B2 | 2/2009 | Sick | |
| 8,057,125 | B2 | 11/2011 | Grinwald | |
| 8,317,426 | B2 | 11/2012 | Steffen | |
| 9,334,613 | B2 * | 5/2016 | Erdmann | E01C 19/283 |
| 2004/0022582 | A1 * | 2/2004 | Sick | E01C 19/004 404/133.05 |

(Continued)

OTHER PUBLICATIONS

"Cubli: Building cubes that can jump up and balance", ETH Zurich, Dept. Mech. and Process Eng'g, Inst. for Dynamic Systems & Control, http://www.idsc.ethz.ch/research-dandrea/research-projects/cubli.html.

(Continued)

*Primary Examiner* — Raymond W Addie
(74) *Attorney, Agent, or Firm* — Andrews Kurth Kenyon LLP; L. Scott Bloebaum

(57) ABSTRACT

Embodiments of the present disclosure include a remotely-operable percussion compactor comprising: a primary power source; a plurality of electric motors coupled to the primary power source and attached to the compactor body; a plurality of reaction wheels coupled to respective electric motors; an inertial measurement unit (IMU); a remote control interface; and a controller configured to: receive one or more commands from the remote-control interface and a feedback signal from the IMU, and set a desired operating condition for at least one of the electric motors based on at least one of the feedback signal and the one or more commands. In some embodiments, the controller can be configured to determine an angular disturbance relative to at least one rotational axis of the compactor; and set the desired operating condition for one or more electric motors to generate a reactive force to at least partially counteract the angular disturbance.

17 Claims, 8 Drawing Sheets

(56) References Cited

U.S. PATENT DOCUMENTS

| | | | | |
|---|---|---|---|---|
| 2006/0193693 | A1* | 8/2006 | Congdon | E01C 19/38 404/133.05 |
| 2008/0247824 | A1* | 10/2008 | Steffen | E01C 19/38 404/133.05 |
| 2010/0166499 | A1* | 7/2010 | Stenzel | B06B 1/186 404/133.05 |
| 2010/0254769 | A1 | 10/2010 | Sick et al. | |
| 2013/0058717 | A1* | 3/2013 | Anderegg | E02D 3/074 404/75 |

OTHER PUBLICATIONS

"The Cubli: a cube that can jump up, balance, and 'walk'"; https://youtu.be/n_6p-1J551Y.

"One dimensional Cubli prototype"; https://youtu.be/KEVghOuZGDU.

Gajamohan, Mohanarajah et al., "The Cubli: A Reaction Wheel Based 3D Inverted Pendulum"; 2013 European Control Conference (ECC), Jul. 17-19, 2013, Zurich, Switzerland, 978-3-952-41734-8/2013 EUCA, pp. 268-274.

Gajamohan, Mohanarajah et al., "The Cubli: A Cube that can Jump Up and Balance"; 2012 IEEE/RSJ International Conference on Intelligent Robots and Systems, Oct. 7-12, 2012, Vilamoura, Algarve, Portugal, 978-1-4673-1735-1/12/S31.00 2012 IEEE, pp. 3722-3727.

Schmidt-Wetekam, Christopher, and Bewley, Thomas; "The Design of an Arm Suspension Mechansim for an Underactuated Single Legged Hopping Robot"; IEEE Int'l Conf. on Robotics & Automation, May 2011, pp. 5529-5534.

Kurokawa, Haruhisa; "A Geometric Study of Single Gimbal Control Moment Gyros—Singularity Problems and Steering Law"; Report of NIAIST Mechanical Engineering Laboratory, No. 175, pp. 1-108, 1998.

Muehlebach, Michael, et al.; "Nonlinear Analysis and Control of a Reaction Wheel-based 3D Inverted Pendulum", IEEE Conf. on Decision & Control, Nov. 2013, 6 total pages.

Product Sheet for B550-4s, BS60-4s, BS70-4As 4 Stroke Rammer; Wacker Nueson; www.wackemueson.com—compiled on May 4, 2016, pp. 1-2.

Product Sheet for DPU130, Reversible Vibratory Plates; Wacker Nueson; www.wackemueson.com—compiled on May 4, 2016, pp. 1-2.

* cited by examiner

REMOTELY-OPERABLE RECIPROCATING COMPACTOR

FIELD OF THE DISCLOSURE

The present application relates generally to the field of percussion soil compactors, also known as rammers or tampers, and more specifically to systems, methods, and apparatus for improving the user safety and performance of reciprocating soil compactors by enabling such devices to be operated remotely without direct contact by a user.

BACKGROUND INFORMATION

Percussion compactors (also known as rammers and tampers) are well known in the construction industry and are used to compact soil and other loose materials in a variety of construction and excavation operations. Such devices are typically manually operated by a single operator. A percussion rammer is distinguishable from a vibration (or vibratory) compactor in terms of both amplitude and frequency of operation. A percussion rammer may operate with a vertical amplitude of approximately 2-3 inches (50-75 mm) and a frequency of about 600-800 cycles per minute (cpm). A vibratory compactor, on the other hand, may operate with a much smaller vertical amplitude, e.g., 0.060 inch (about 1.5 mm) and a much higher frequency, e.g., 4,000-6,000 cpm.

A typical percussion rammer thus provides a generally vertically oriented, large amplitude movement to a flat soil engaging shoe that compacts the soil with a pounding type of movement. The compacting shoe is typically mounted with its flat surface at an angle slightly less than 90° to the vertical and, as a result, the operating axis along which the percussive tamping movement is transmitted is slightly forwardly-inclined. The angle of operating movement may be, for example, 15° to the vertical. This angled orientation results in a forward component of motion with every stroke and permits the operator to guide the machine in a forward operating path over the surface by grasping a horizontal operator handle at the rear of the machine. The operator handle is typically attached to the rear of a frame that includes two generally horizontal laterally spaced components that are attached by their opposite forward ends to a cushioning pivot mechanism near the upper end of the operating axis. The cushioning pivot arrangement typically comprises a pair of large elastomeric elements interposed between the forward ends of the lateral frame members and the body of the machine, so the frame and operator handle may pivot vertically relative to the rammer as it moves up and down. This arrangement helps isolate the generally vertical component of operating movement from the operator handle and the hands of the operator grasping the handle. However, because of the inclined orientation of the operating axis of the machine, there is a significant horizontal component of movement that the torsional mounting of the side frame to the machine does little to damp or isolate. This horizontal component of movement is thus transmitted directly through the side frame members to the operator handle and the hands of the operator.

Worker safety regulations worldwide have examined the effects of hand/arm vibration levels in manually operated vibratory equipment. Some jurisdictions have effected regulations that apply measured vibration levels to operating time to make sure that operators are given periodic rests while using such equipment. Various solutions have been proposed to reduce vibration levels experienced by the machine operator, with the expectation that such lower levels may increase allowable operator time and/or reduce the length and/or frequency of operator periods.

One such solution is described in U.S. Pat. No. 6,749,365. In this solution, an operator handle assembly is provided for a percussive soil compacting device to isolate generally horizontal components of operating movement from the hands of the operator, the assembly including a main frame attached at one end to the compacting device, and a manually engageable operator handle attached to the other end of the main frame with a shock absorbing mount oriented to absorb generally horizontal components of operating movement. In a preferred embodiment, the main frame includes a pair of laterally spaced frame members having ends adjacent the operator handle and the operator handle includes a generally horizontal manually engageable member having opposite lateral ends; the shock absorbing mount comprises a pair of torsionally resilient shock absorbers each of which is attached with a first connector to an end of said frame member and with a second connector to a lateral end of the operator handle, the first and second connectors oriented to position the shock absorbers on a common torsional axis that is vertically offset from and generally parallel to the horizontal member. The shock absorbers preferably comprise elastomeric elements, each element being mounted between said first and second connectors.

A principal drawback of such solutions is that they still require the operator to maintain contact with the percussive soil compactor for extended periods of time, during which he or she continues to absorb vibrations. Even though such vibrations may be reduced in magnitude, the long-term effects on operators who regularly use such equipment over extended periods is unknown at best—and potentially very hazardous. It would be beneficial, then, to address these known and potential problems by eliminating the need for the operator to maintain contact with a percussive soil compactor during its operation.

SUMMARY OF EXEMPLARY EMBODIMENTS

Accordingly, to address at least some of such issues and/or problems, certain exemplary embodiments of apparatus, devices, and methods according to the present disclosure include a remotely-operable percussion compactor, comprising: a primary power source; a plurality of electric motors, each coupled to the primary power source and attached to the body of the percussion compactor; a plurality of reaction wheels coupled to respective ones of the electric motors; an inertial measurement unit; a remote control interface; and a controller configured by execution of programmable instructions to: receive one or more commands from the remote-control interface; receive a feedback signal from the inertial measurement unit; and set a desired operating condition for at least one of the electric motors based on at least one of the feedback signal and the one or more commands. In certain exemplary embodiments, the primary power source comprises an internal combustion engine and the electric motors are coupled to the internal combustion engine via an electric generator. In certain exemplary embodiments, the plurality of electric motors comprise brushless DC motors. Some exemplary embodiments further comprise a remote-control unit capable of communicating with the remote-control interface.

In certain exemplary embodiments of the present disclosure, the one or more commands pertain to at least one of: i) position, velocity, and/or acceleration of the compactor relative to a lateral surface of a working area; and ii) angular displacement, velocity, and/or acceleration relative to at least one rotational axis of the compactor. In certain exemplary embodiments, the feedback signal comprises at least one of: i) linear position, velocity, and/or acceleration of the compactor relative to a reference frame; and ii) angular displacement, velocity, and/or acceleration relative to at least one rotational axis of the percussion compactor.

Certain exemplary embodiments further comprise a frame attached to the body of the percussion compactor, wherein at least one or more of the electric motors are attached to the frame. In some exemplary embodiments, the frame is rigid. In some exemplary embodiments, the frame comprises two frame portions arranged at substantially right angles to each other, with both frame portions attached to the compactor body and at least one electric motor attached to each frame portion. In other exemplary embodiments, the frame comprises two co-planar frame portions disposed around a center member, which is attached to the body of the percussion compactor, and the two frame portions are movable relative to each other within their common plane. Each frame portion can further comprise an end member, disposed opposite the attachment to the center member, to which an electric motor is attached.

These and other objects, features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Further objects, features and advantages of the present disclosure will become apparent from the following detailed description taken in conjunction with the accompanying Figures showing illustrative embodiments, in which.

While the present disclosure will now be described in detail with reference to the figures, it is done so in connection with the illustrative embodiments and is not limited by the particular embodiments illustrated in the figure(s) or in the appended claims.

DETAILED DESCRIPTION OF EXEMPLARY EMBODIMENTS

Remotely-controlled vibratory compactors are known in the art. For example, U.S. Pat. No. 7,354,221 describes a vibratory compactor that includes at least one ground contact plate and one or more excitation devices configured to actuate the contact plate(s) to produce vibration. The vibratory compact includes a power system configured to supply power to the excitation devices and a controller configured to control operation of the excitation devices. For example, the power system can comprise an internal combustion engine that supplies power to each excitation device via a crankshaft. In the case of multiple contact plates, each excitation device can be oriented at a non-normal pitch angle (e.g., <90 degrees) relative to its contact plate so as to create both vertical and horizontal excitation of the contact plate. By cooperative excitation of the various contact plates, the compactor can be propelled laterally over the surface of the stratum.

The compactor can also include a signal receiver to pick up remote control signals from a transmitting input device. The transmitting input device can be a hand-held remote control unit and can be configured to transmit radio signals, infrared signals, etc. The compactor's signal receiver can be configured to receive these signals and relay them to the controller. Alternatively or additionally, remote control signals can be transmitted to the compactor via a cable connecting it to the input device. The compactor can also be configured to operate autonomously, e.g., based on positioning signals provided by a Global Positioning System (GPS) receiver.

Although remotely-controlled vibratory compactors eliminate the transmission of vibrations to the operator, they have several characteristics that limit their usage. First, such devices tend to be very large and heavy, making them difficult to transport and maneuver in space-constrained environments or worksites. For example, the DPU-130 vibratory compactor, sold by Wacker-Neuson Corp. of Milwaukee, Wis., has an operating base of 47 inches and an operating weight of over 2,600 pounds. Such equipment cannot be moved manually, and requires truck transport and means for loading/unloading. Second, vibratory compactors are often designed to match the productivity of even larger equipment at lower cost. For example, the DPU-130 is said to match the productivity of a seven-ton roller but with much lower purchase and operating costs. As such, the size and cost of vibratory compactors make them unsuitable for use on smaller tasks by single individuals lacking budget and large transport means.

Figure 1:
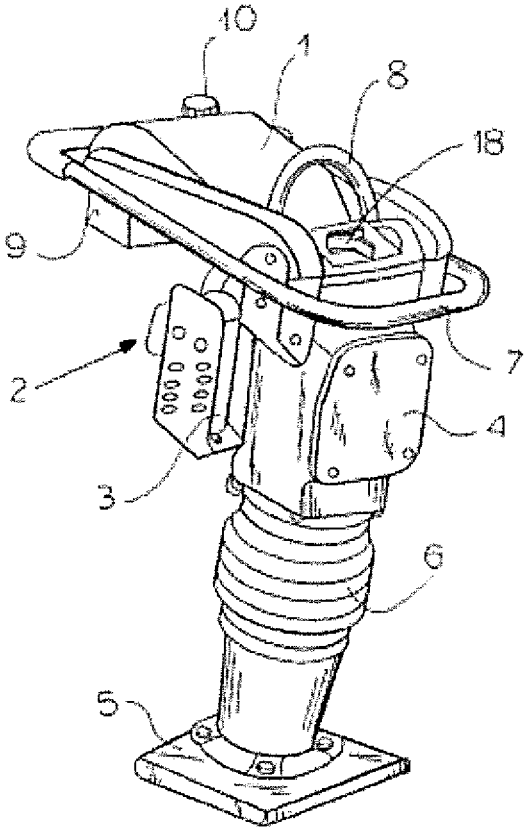
FIG. 1 is a perspective view of an exemplary percussion compactor.

Rather, these applications are most suitable for percussion compactors. An exemplary percussion compactor is shown in FIG. 1. The exemplary percussion compactor includes an internal combustion (e.g., gasoline or diesel) engine 2 mainly underneath a downwardly concave dome-shaped cover 1 and having an exhaust or muffler 3. A housing 4 carries the engine 2 and contains a transmission that converts the engine's rotary output into generally vertical linear movement of a tamping (or contact) plate 5, with an accordion-type cuff or bellows 6 connected between the housing 4 and the plate 5. An annular or bow-type handle 7 formed of round-section tubing is fixed at the upper end of the housing 4 and a loop 8 is optionally provided for the operator to grasp the device for moving by hand. The handle 7 extends around a fuel tank 9 having a fill spout 10 and a lever 11 controlling the speed of the engine 9 is mounted on this handle 7. The cover 1 extends over the engine 2, muffler 3, and fuel tank 9.

The smaller size and upright orientation of the percussion compactor enables users to get much closer to obstacles and work in smaller, confined workspaces (e.g., narrow trenches) compared to vibratory compactors. In addition, percussion compactors generally weigh at least an order of magnitude less than vibratory compactors, enabling operation, loading/unloading, and transport by single individuals. The costs of percussion compactors also make them suitable for use by individuals, either by purchase or rental. For example, the MS590 percussion tamper, sold by Chicago Pneumatic Corp., weighs only 137 pounds and is available for sale at ~$3000 at the time of this application.

Nevertheless, percussion compactors suffer from the vibration transmission problems discussed above. Moreover, due to the great differences in size, weight, shape, and configuration, the solutions for remote operation of vibratory compactors are not applicable to percussion compactors. For example, percussion compactors cannot move laterally by cooperative excitation of contact plates because they utilize only a single tamping plate coupled to the engine by a single mechanism (e.g., transmission and/or driveshaft). Instead, conventional percussion compactors require the user to manually direct any lateral motion during operation. In addition, the combination of the larger vertical vibration amplitude, upright orientation, and top-heavy weight distribution (e.g., engine well above ground level) make percussion compactors difficult to stabilize during operation without user intervention—especially when used on uneven terrain often found at worksites.

As explained below in more detail, applicants have recognized these problems and have provided a remotely-operated percussion compactor (or tamper) that remains stable when operated over uneven terrain and is able to move laterally in a desired direction, without manual direction by the user. This manner of remote operation greatly improves the health, safety, and welfare of operators while enabling the apparatus to be meet the performance requirements of conventional, manually-operated percussion compactors. More specifically, applicant has recognized that various inertial devices can be applied to regulate attitude and/or orientation of the percussion compactor and to facilitate desired lateral movement by remote control of an operator.

The term "reaction wheel" often refers to a driven flywheel that is used to regulate the attitude of any attached bodies about the wheel's axis of rotation. Three-dimensional (x,y,z) arrays of reaction wheels have been used to control 3-D attitude (e.g., orientation) of space-borne vehicles such as satellites. In contrast to gyroscopes, which spin at a fixed velocity, reaction wheels spin at variable angular velocities that are determined by the amount of angular momentum (or torque) they are applying to, or absorbing from, the body (e.g., satellite) to which they are attached. For example, external disturbances to a body can be measured and the feedback used to determine a corresponding angular momentum to be applied to the body to counteract such disturbances. Alternately, the body's attitude about an axis can be selectively changed by transferring angular momentum from the reaction wheel into the body.

Figure 2:
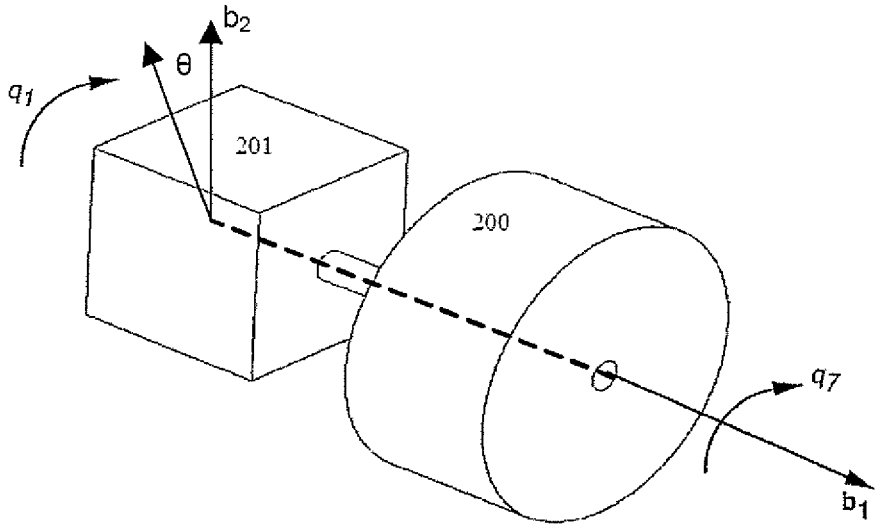
FIG. 2 is a diagram illustrating the principles of operation of a one-dimensional reaction wheel system.

An exemplary configuration of a reaction wheel is shown in FIG. 2. In this figure, reaction wheel 200 is coupled to body 201 by a fixed mechanism, e.g., a shaft as shown. In some embodiments, the mechanism can be a power source (e.g., electric motor) fixed to body 201 that is coupled to wheel 200 by a rotating driveshaft. Although reaction wheel 200 is shown as a solid disk, skilled persons will recognize that other shapes or configurations can be used including, e.g., a wheel having mass concentrated in an outer ring of a thickness much less than the wheel radius, and connected by spokes to a center hub. In FIG. 2, vector $b_1$ depicts the rotational axis of wheel 200 while vector $b_2$ depicts the vertical axis through body 201 that is normal (i.e., perpendicular) to $b_1$. Applying a rotational force $q_7$ in a particular direction by angular acceleration of wheel 200 (by, e.g., a motor attached to body 201) causes an equal but opposite (e.g., reactional) rotational force to be applied to body 201. In this manner, the rotational orientation of body 201 with respect to $b_2$ can be changed by some desired angle $\theta$. Conversely, an undesired rotational force $q_1$ applied in a particular direction to body 201 causes an angular displacement $\theta$ with respect to $b_2$. If this angular displacement—together with, e.g., angular velocity $\omega$ and/or angular acceleration a—can be measured, sensed, or otherwise determined, an equal rotational force $q_1$ can be applied to wheel 200 to cause an opposite (e.g., reactional) rotational force in body 201, thereby causing it to rotate back towards the to the desired orientation $b_2$.

Figure 3:
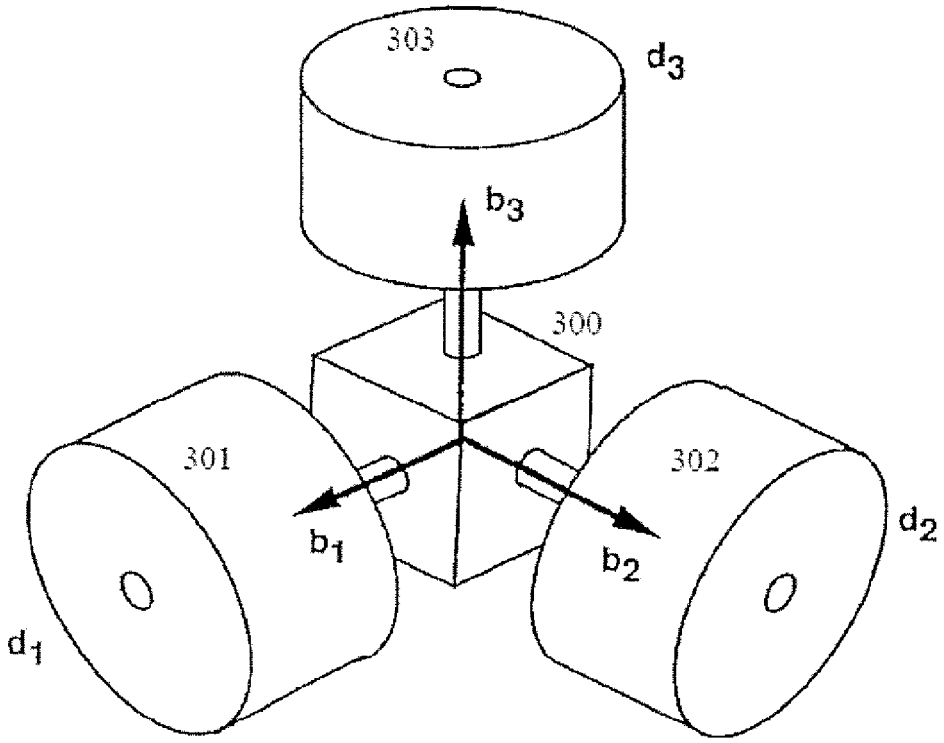
FIG. 3 is a diagram illustrating the principles of operation of a three-dimensional reaction wheel system.

Moreover, although FIG. 2 shows a single reaction wheel capable of applying torque to a body in a single rotational dimension, multiple reaction wheels can be coupled to a body so as to provide torque in two or more independent rotational dimensions (e.g., non-co-planar axes or degrees of freedom). FIG. 3 shows an example of a three-dimensional (3-D) reaction wheel system capable of controlling orientation of body 300 independently for three mutually normal axes depicted as vectors $b_1$, $b_2$, and $b_3$. As described with respect to FIG. 2, each reaction wheel 301-303 is coupled to body 301 by a mechanism such as an electric motor that is fixed to body 301 and coupled to the respective wheel by a driveshaft. If an undesired 3-D angular displacement $\theta$ caused by a rotational force on body 300 can be measured, sensed, or otherwise determined—together with, e.g., 3-D angular velocity $\omega$ and/or 3-D angular acceleration a—an equal rotational force can be applied to wheels 301-303 to cause an opposite (e.g., reactional) rotational force in body 301. Exemplary As mentioned above, various embodiments can utilize an electric motor that is fixed to body 201 to provide the desired rotational force $q_7$ to wheel 200. In various embodiments, the electric motor can be a DC motor or an AC motor (synchronous or induction). The general relationship between the output power of the electric motor, the configuration of the wheel, and the desired torque to be applied can be expressed in various ways, including:

$$P = \frac{k \cdot \tau^2 \cdot t}{m \cdot r^2}$$

where P is the output power of the motor (in W), m is the mass of the wheel (in kg), r is the radius of the wheel (in m), $\tau$ is the torque (in N·m) applied by the motor to the wheel (and also the reactionary torque in the body), t is the duration of time the torque is applied (in sec), and k is a unit-less constant ranging from 1 (very thin annulus or ring) to 2 (solid disk) depending on the wheel configuration. In terms of the wheel, torque $\tau$ can be expressed as the product $I_w \cdot \alpha$, where $I_w$ is the wheel's moment of inertia (in kg-m$^2$) and $\alpha$ is the wheel's angular (rotational) acceleration (in radians/s$^2$). In terms of output by an electric motor—particularly a DC motor—torque $\tau$ can be expressed as the product $K_m \cdot u$, where u is the input current (in A) and $K_m$ is the torque constant for the particular motor.

By using these various relationships and combining them with various body characteristics (e.g., mass M and moment(s) of inertia $I_b$ in one or more body dimensions) and the response time to undesired disturbances to the body, a skilled person can determine requirements for reaction wheel parameters such as motor output power P, wheel radius r, wheel mass m, etc. Use of these relationships are well known to persons skilled in the technical field of attitude or orientation control, particularly in the context of spacecraft attitude control, as described in U.S. Pat. No. 5,754,023, for example.

As mentioned above, applicants have recognized various problems with conventional, hand-operated percussion compactors (or tampers) and have provided a remotely-operated percussion compactor that can incorporate various inertial devices to regulate attitude and/or orientation of the percussion compactor and to facilitate desired lateral movement by remote control of an operator. Exemplary embodiments of the present disclosure utilize a plurality of reaction wheels, each coupled by a shaft to an electric motor that is fixedly attached to the rigid body of the percussion compactor. In such exemplary embodiments, torque applied by an electric motor to a coupled reaction wheel causes an equal but opposite torque in the percussion compactor body around the reaction wheel's axis of rotation.

Figure 4A:
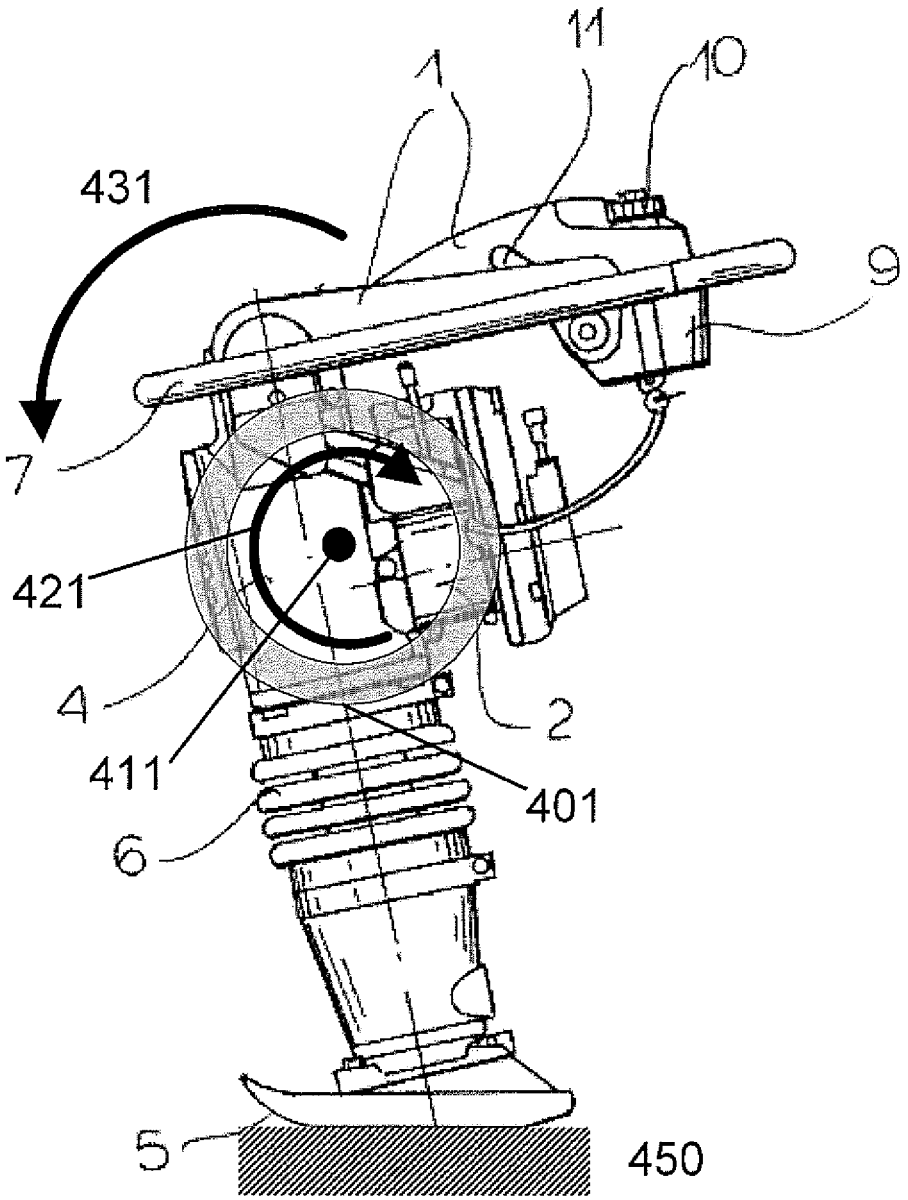
FIG. 4*a* is a diagram illustrating the principles of operation of a single-dimension reaction wheel as applied to the exemplary percussion compactor of FIG. 1, according to one or more embodiments of the present disclosure.

FIG. 4*a* shows an exemplary embodiment illustrating this principle of operation. In FIG. 4, the exemplary percussion compactor of FIG. 1 is further equipped with a reaction wheel 401 having an axis of rotation 411. Reaction wheel 401 is shown having mass concentrated in an annulus with an outer diameter and an inner diameter that can range from zero (e.g., solid disk) to just less than the outer diameter. The necessary connections (e.g., one or more spokes) between annular wheel 401 and axis 411 are not shown for sake of clarity. Axis 411 can correspond to a drive shaft of an electric motor (not shown) that is fixedly attached to housing 4 in some manner, as described in more detail herein below. When a rotational force 421 (e.g., a torque) is applied (e.g., by an electric motor) to cause wheel 401 to rotate in a clockwise direction around axis 411 as shown, it causes an equal but opposite rotational force 431 (e.g., a torque) to be applied to the percussion compactor around axis 411. If plate 5 is in contact with ground 450, force 431, if sufficiently large, can cause the compactor to rotate counterclockwise about the forward-most contact point between plate 5 and ground 450. In such case, the rounded front edge of plate 5 can remain in contact with ground 450 as the compactor "tips" forward. Similarly, if rotational force 421 is suddenly reversed (e.g., by reversing the electric motor), the equal but opposite force 431 will also reverse, which can cause the exemplary compactor to rotate counterclockwise about the contact point between plate 5 and ground 450, thereby tipping backward toward its stable, resting position.

Figure 4B:
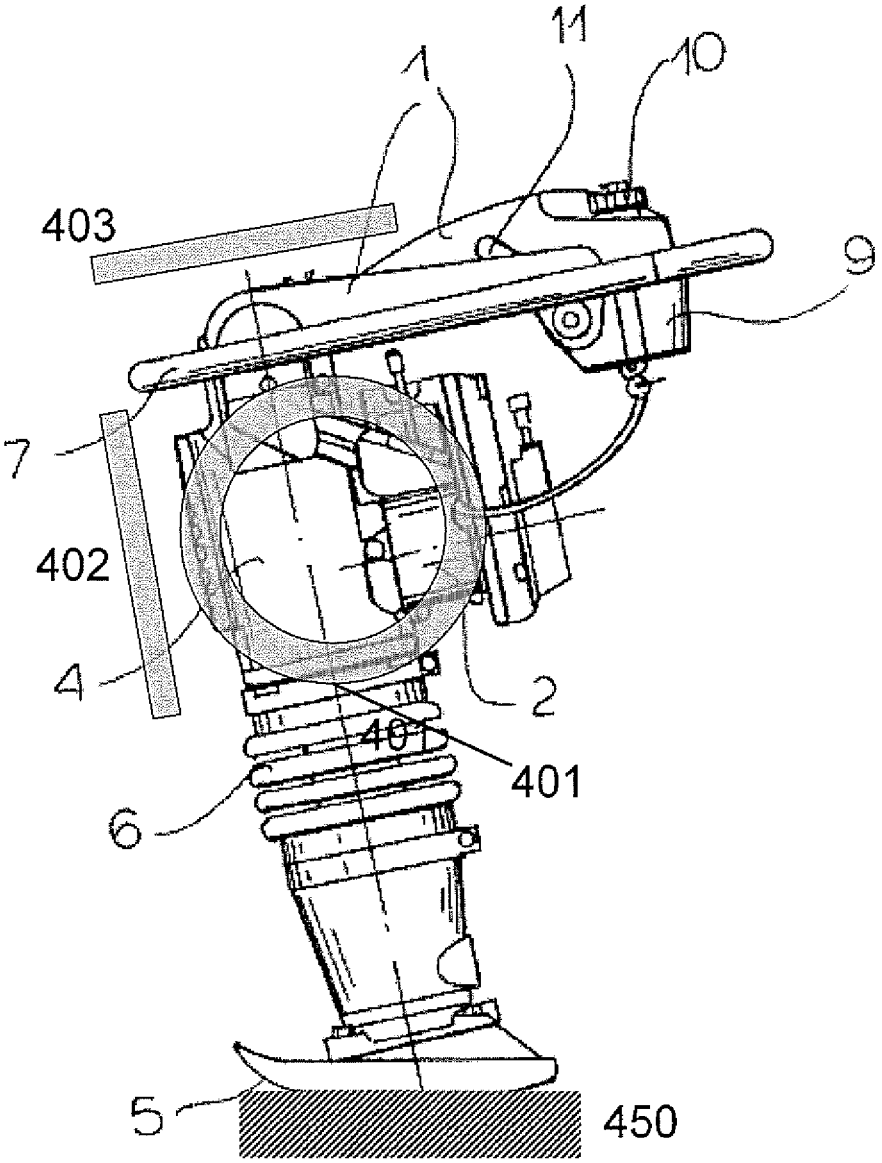
FIG. 4*b* is a diagram illustrating an exemplary configuration of a three-dimensional reaction wheel system as applied to the exemplary percussion compactor of FIG. 1, according to one or more embodiments of the present disclosure.

While FIG. 4*a* shows an exemplary embodiment that illustrates principles of operation in one rotational dimension, other exemplary embodiments can be configured to operate in multiple rotational dimensions. For example, FIG. 4*b* shows the exemplary percussion compactor of FIG. 1 and FIG. 4*a* further equipped with two additional reaction wheels 402 and 403. Although not shown, each of reaction wheels 402 and 403 have a rotational axis similar to axis 411 of wheel 401. In some embodiments, the rotational axes of wheels 401, 402, and 403 can be mutually perpendicular, e.g., parallel with the orthogonal basis vectors of a three-dimensional coordinate system. In some embodiments, the rotational axes of wheels 401, 402, and 403 can intersect in a single point. Although not shown in FIG. 4*b*, each of the axes can correspond to a drive shaft of an electric motor that is fixedly attached to housing 4 in some manner, as described in more detail herein below. For example, each of the electric motors can be attached to a rigid frame that is mounted to housing 4, such that torque applied to the rigid frame around a particular axis of rotation is transmitted to housing 4, causing it also to rotate around that axis of rotation.

Figure 5:
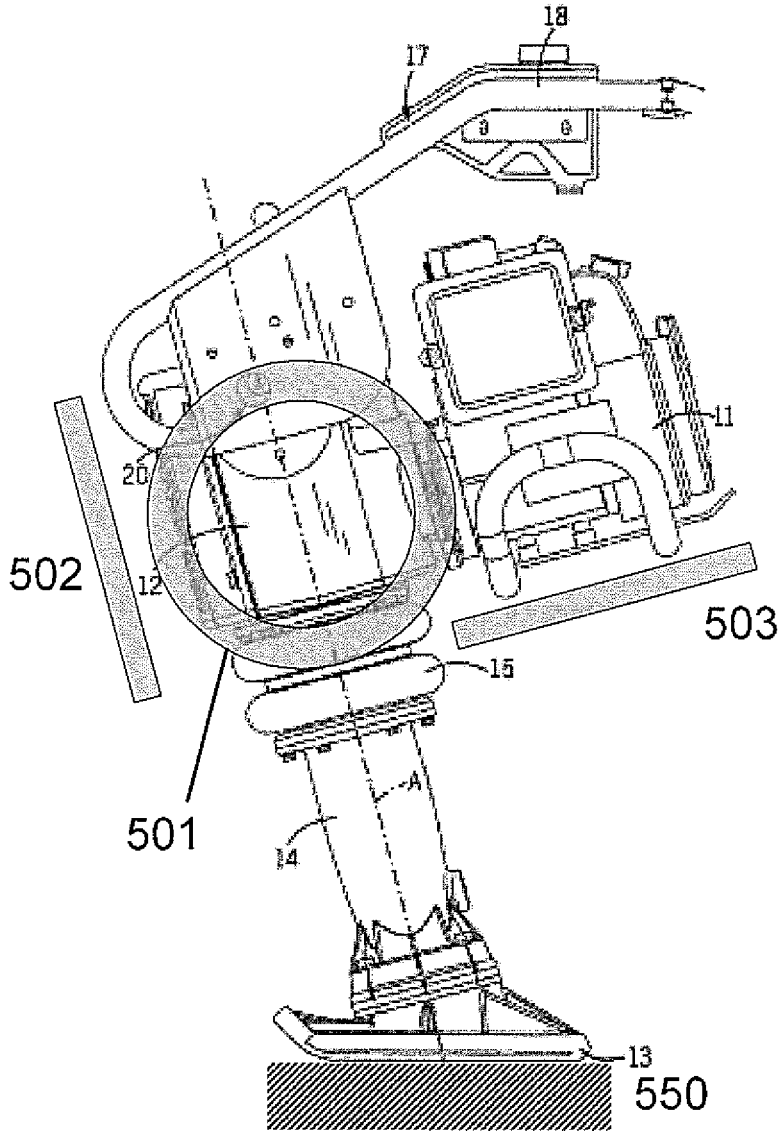
FIG. 5 is a diagram illustrating another exemplary configuration of a three-dimensional reaction wheel system as applied to another exemplary percussion compactor, according to one or more embodiments of the present disclosure.

The location of the reaction wheels relative to the housing shown in FIGS. 4*a* and 4*b* is merely exemplary, and other configurations are possible and can be preferable depending on the particular requirements and/or arrangement of the components of a percussion compactor. FIG. 5 illustrates another exemplary embodiment of the present disclosure. The exemplary percussion compactor includes an internal combustion engine (ICE) 11 that can be mounted to the rear of a transmission housing 12 comprising a transmission that can convert the rotary output of the engine into generally vertical reciprocating movement of a lower tamping plate 13. The transmission housing 12 and tamping shoe 13 can be interconnected by a percussion housing 14 and a flexible elastomer bellows 15. A reciprocating piston and oppositely biased spring arrangement can be disposed within the percussion housing 14; such arrangement can be connected to the transmission and can impart a reciprocating tamping movement to plate 13 in a manner well known in the art. An operator handle 16 can be connected to the compactor by an upper frame 17 that can include a pair of laterally spaced side frame members 18 which can be attached at their front ends to opposite sides of the transmission housing 12 with, e.g., a pair of laterally aligned pivotal connections 20.

In addition, the exemplary percussion compactor shown in FIG. 5 includes reaction wheels 501, 502, and 503, which can operate in a similar manner as reaction wheel 401 described above with reference to FIG. 4*a*. Reaction wheels 501 and 502 can be located in similar positions as reaction wheels 401 and 402, respectively, in FIG. 4*b* while reaction wheel 503 can be placed lower and more rearward than reaction wheel 403. The placement of reaction wheel 503 can be due to factors including, but not limited to: availability of a convenient and/or appropriate mounting frame (e.g., under frame of ICE 11); requirements that prevent placement in certain other positions (e.g., requiring the top of the compactor to be free from obstruction, such as by the placement of wheel 403); operational stability (e.g., using wheel 503 as a counterbalance to wheel 502); motor and/or reaction wheel design tradeoffs (e.g., less rotational force required to achieve same torque if applied to a longer distance/moment arm); and other factors.

Figure 6:
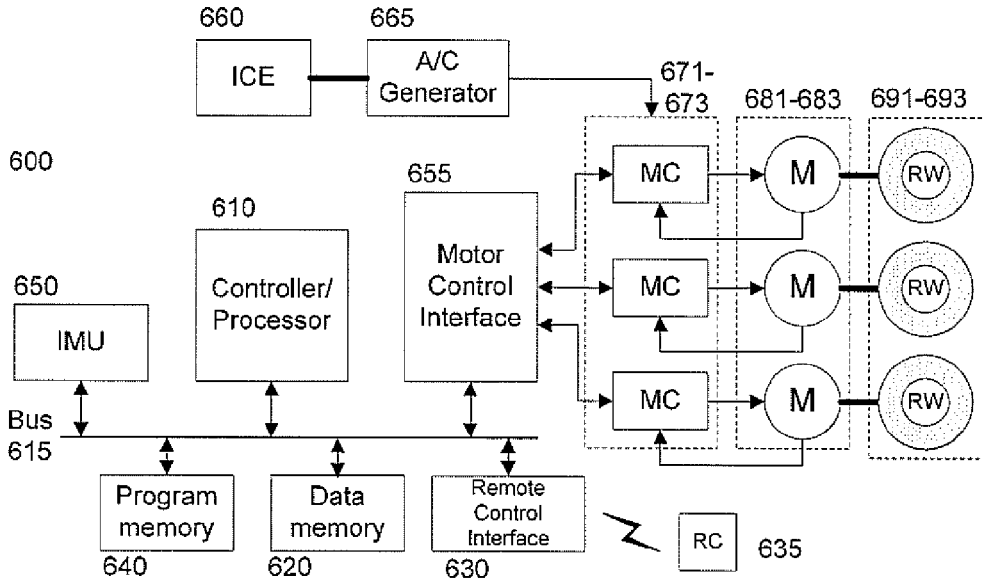
FIG. 6 is a schematic diagram of an exemplary electromechanical control system that can be utilized with exemplary percussion compactor embodiments of the present disclosure.

FIG. 6 shows a block diagram of an exemplary electromechanical control system 600 for various embodiments of the remote-controlled reciprocating compactor of the present disclosure. Exemplary system 600 can comprise a processor 610 that can be operably connected to a program memory 620 and/or a data memory 630 via a bus 615 that can comprise parallel address and data buses, serial buses, or other methods and/or structures known to those of ordinary skill in the art. Program memory 620 comprises software code or program executed by processor 610 that facilitates, causes and/or programs processor 610 to communicate with various other system components including, but not limited to, 3-D inertial measurement unit (IMU) 650, remote control interface 630, and/or motor control interface 655. Program memory 620 can also comprise software code executed by processor 610 to control and/or monitor feedback from electromechanical devices comprising system 600, including 3-D inertial measurement unit (IMU) 650 and motors 681-683 (e.g., via motor control interface 655 and motor controllers 671-673, respectively). Program memory 620 can also comprise software code executed by processor 610 to communicate with a remote control device (not shown) via remote control interface 630.

Software code comprising program memory 620 can be specified or written using any known or future developed programming language, such as e.g. Java, C++, C, Objective C, HTML, XHTML, machine code, and Assembly, as long as the desired functionality, e.g., as defined by the implemented method steps, is preserved. In addition or alternately, program memory 620 can comprise an external storage arrangement (not shown) remote from system 600, from which the instructions can be downloaded into program memory 620 located within or removably coupled to system 600, so as to enable execution of such instructions.

Data memory 630 can comprise memory area for processor 610 to store variables used in protocols, configuration, control, and other functions of system 600, including estimating the direction-of-arrival of an incident signal and/or adjusting the spatial selectivity of a receiver antenna array in accordance with the estimated direction of arrival, according to one or more of the embodiments described herein above. Moreover, program memory 620 and/or data memory 630 can comprise non-volatile memory (e.g., flash memory), volatile memory (e.g., static or dynamic RAM), or a combination thereof. Furthermore, data memory 630 can comprise a memory slot by which removable memory cards in one or more formats (e.g., SD Card, Memory Stick, Compact Flash, etc.) can be inserted and removed. Persons of ordinary skill in the art will recognize that processor 610 can comprise multiple individual processors (including, e.g., multi-core processors), each of which implements a portion of the functionality described above. In such cases, multiple individual processors can be commonly connected to program memory 620 and data memory 630 or individually connected to multiple individual program memories and or data memories. More generally, persons of ordinary skill in the art will recognize that various protocols and other functions of system 600 can be implemented in many different computer arrangements comprising different combinations of hardware and software including, but not limited to, application processors, signal processors, general-purpose processors, multi-core processors, ASICs, fixed and/or programmable digital circuitry, analog baseband circuitry, radio-frequency circuitry, software, firmware, and middleware.

In some embodiments, remote control interface 630 can comprise a radio-frequency receiver that can receive commands and/or responses from a remote control device (RC) 635 that supports compatible wireless communication standards and/or protocols. In some exemplary embodiments, remote control interface 630 can also comprise a radio-frequency transmitter that can transmit commands and/or responses to RC 635. The combination of a transmitter and receiver providing bi-directional communication is commonly known to skilled persons as a "transceiver", the term that will be used in the following description. Skilled persons will readily comprehend that receivers, transmitters, and transceivers can include not only radio circuitry but also digital logic, controllers, firmware, etc. that facilitate communication. Although shown coupled to bus 615, skilled persons will readily comprehend that interface 630 can be connected such that it communicates directly with processor 600, e.g., via a dedicated port.

In some embodiments, the transceiver of interface 630 can be configured to communicate directly with RC 635 in a "peer-to-peer" topology. Such embodiments can include and/or utilize any peer-to-peer communication technologies and/or protocols known to skilled persons, including IEEE 802.11 WiFi, Bluetooth, Zigbee, Z-Wave, or proprietary (e.g., non-standardized) short-range radio interfaces and/or protocols. In other exemplary embodiments, the transceiver of interface 630 can be configured to communicate with RC 635 in a "networked" topology, e.g., via an intermediary access point or base station. Such embodiments can include and/or utilize any networked communication technologies and/or protocols known to skilled persons, including standardized technologies such as 802.11 WiFi, Long Term Evolution (LTE, also known as "4G" or "4G-LTE"), UMTS, CDMA, EDGE, GPRS, GSM, CDPD, and TDMA, as well as proprietary long-range radio network interfaces and/or protocols. Various higher-layer protocols for remote controller communication can be utilized with any of these peer-to-peer and networked radio technologies, including Fast Remote Procedure Call (FRPC2).

Although the above description indicates peer-to-peer and networked communication modes as alternatives, they are not exclusive and the transceiver of interface 630 can include circuitry enabling it to communicate with RC 635 according to both modes. Moreover, in some exemplary embodiments, the transceiver can include circuitry enabling communicating with RC 635 over a wired medium, e.g., a cable. This capability can be based on various wired communication technologies including, e.g., IEEE 802.3 Ethernet, CAN, ProfiBus, etc. Such technologies can be coupled with various higher-layer protocols known to skilled persons, including CANOpen, CANOpen Safety, SafetyBusP, ProfiSafe, EtherCAT, etc.

Various remote control devices known to persons of ordinary skill can be used in conjunction with interface 630. Such remote control devices can include, for example, a keypad and/or keyboard (e.g., for entering commands, configuration information, security codes, etc.); one or more directional control devices, such as a joystick, trackball, etc.; a display device, such as an LCD screen; one or more other input devices, such as a touch screen; a wireless and/or wired transceiver compatible with the transceiver of interface 630; a battery or other energy storage device for powering the above components; and a housing that incorporates all, or some portion of, the above components. Suitable remote control devices can include special-purpose remote controls as well as general-purpose computing devices, such as a laptop computer, smartphone, tablet, etc., that are capable of being configured (e.g., by a stored or downloadable application) to communicate with interface 630 for remotely controlling the reciprocating compactor.

Furthermore, although various exemplary embodiments described herein are characterized as "remotely operable" or under "remote control," this merely describes exemplary capabilities and is not intended to exclude these or other exemplary embodiments from being manually operable by physical contact from an operator. Such manual operation could be enabled and/or disabled, e.g., by user manipulation of the remote control device and/or the compactor itself.

Continuing with the description of FIG. 6, motor control interface 655 can take various forms depending on the particular configurations or embodiments of processor 600, bus 615, and motor controllers 671-673. For example, motor control interface 655 can comprise circuitry to translate the bus 615 interface to processor 600 to a serial interface to controllers 671-673. Exemplary serial interfaces include, but are not limited to, RS-232, RS-485, USB, HDMI, IEEE 1394 ("Firewire"), $I^2C$, ISO-11898 CAN, IEEE 802.3 Ethernet, or the like. In some exemplary embodiments of the present disclosure, the interface 655 can comprise analog interface circuitry including, for example, one or more digital-to-analog (D/A) and/or analog-to-digital (A/D) converters.

Inertial measurement unit (IMU) 650 can include one or more devices for measuring the linear and/or rotational displacement, velocity, and/or acceleration of each axis of the remotely-controlled percussion compactor. In some embodiments, IMU 650 can include a three-axis accelerometer and a three-axis rate-gyroscope. In some embodiments, IMU 650 can comprise a plurality of accelerometer-gyroscope pairs, each pair oriented in a known direction relative to the other pair. An exemplary accelerometer is the ADXL345 sold by Analog Devices, Inc., and an exemplary rate-gyro is the IDG-500/ISZ-500 series sold by Invensense. Alternately, a device from Invensense's six-axis family of motion sensors that incorporates both a three-axis gyroscope and a three-axis accelerometer on the same silicon die can be utilized. IMU 650 can be mounted in a known orientation with respect to the frame of the compactor, but can be located on the same or different circuit board as processor 600 and other digital components. Processor 600 can configure IMU 650 to provide up to six-dimensional (3-D angular plus 3-D linear) measurements of displacement, velocity, and acceleration on a periodic basis or on demand. Upon receiving these measurements, processor 600 can determine the amount of rotational force (if any) that should be applied to each of reaction wheel 691-693 in order to counteract the movement of the compactor.

Reaction wheels 691-693 are coupled to electric motors 681-683, respectively, which are in turn electrically coupled to motor controllers 671-673, respectively. Processor 600 can cause a rotational force—or change thereof—to be applied to a reaction wheel coupled to a motor by causing the corresponding motor controller to vary the current and/or voltage applied to that motor. The current and voltage can be supplied to the electric motors 681-683 by an AC generator 665 via respective motor controllers 671-673. In turn, AC generator 665 is coupled to internal combustion engine (ICE) 660 (e.g., ICE 11 shown in FIG. 5) via a geared driveshaft such that, when ICE 660 is operational, AC generator 665 outputs a particular voltage (e.g., 120V) and frequency (e.g. 50 or 60 Hz). The output frequency of generator 665 can be configured by selection of a particular gear ratio based on the nominal operational speed (e.g., RPMs) of ICE 660, as known to persons of ordinary skill.

Figure 7:
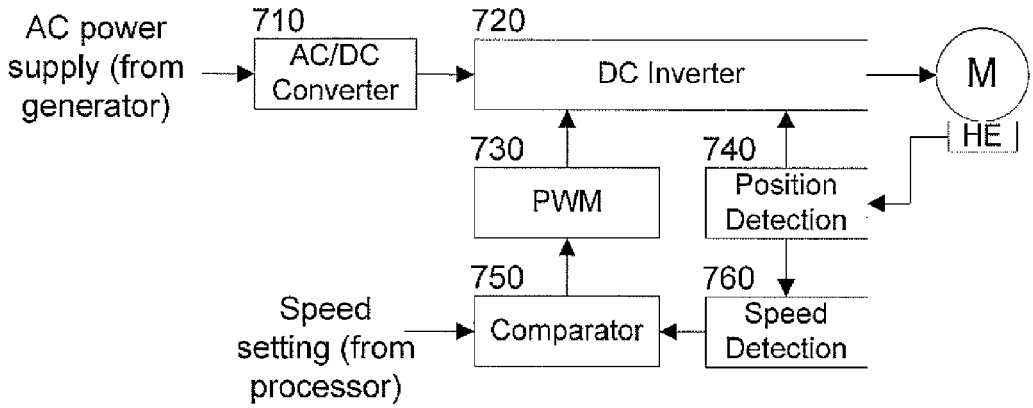
FIG. 7 is a block diagram of an exemplary brushless DC motor controller that can be utilized with various exemplary embodiments of the present disclosure.

Although any type of AC or DC electric motor can be used as motors 681-683, brushless DC motors can be preferable in some embodiments due to their smaller size (volume) for a given power output, greater input/output efficiency, faster output responsiveness to input changes (due to reduced rotor inertia), and increased reliability and/or service life compared to brushed DC and AC motors. In such embodiments, motor controllers 671-673 can be configured according to the block diagram of the exemplary brushless DC motor controller shown in FIG. 7. In this figure, AC/DC converter 710 receives an AC voltage/current input, e.g., from generator 665, and converts it to a DC voltage/current according to principles known to persons of ordinary skill. This DC voltage/current is then applied to a pulse-width modulated (PWM) DC inverter 720, which creates a three-phase AC voltage by turning ON and OFF six switching elements (e.g., FETs or IGBTs) in a prescribed sequence and with ON-OFF timing determined by the relative widths of the pulses received from PWM generator 730. The AC voltage is applied to the stator of the motor (M), with the inverter switching sequence determined by feedback signals from a plurality of Hall Effect (HE) sensors spaced around the circumference of the stator. Some embodiments can comprise three HE sensors spaced at 120-degree intervals. The operational principles of HE sensors are known to persons of ordinary skill and, accordingly, are not described further herein.

These HE output signals are used by block 740 to detect motor rotational position, which is applied both to the inverter 720 and a speed detector 760. The output of block 760 can be applied to comparator 750, which outputs a signal representing the difference between the desired speed setting (e.g., from processor 600) and the detected speed. This difference signal is applied to PWM block 730, where it is used to control the duty cycle (e.g., relative ON-OFF timing) of the six switching elements. Based on the control of the duty cycle, the controller can reduce the input to the motor if the detected motor speed is higher than desired and can increase the input if the detected speed is lower than the desired speed. The value of the motor input current can also be determined by the PWM block 730 based on the deviation signal.

As discussed above, the electric motors used to apply rotational force to the reaction wheels can be fixedly attached to the body of the percussion compactor in various ways. In some embodiments, a housing of the compactor (e.g., housing 4 in FIG. 4 or housing 12 in FIG. 5) can be fabricated (e.g., cast) with one or more recesses into which respective electric motors can be at least partially inserted and fixedly attached. The inner dimensions of such recesses can be determined based on the outer dimensions of the electric motor, so as to provide a snug fit to facilitate transferring reactive torque from the motor to the body of the reciprocating compactor. In various embodiments, such recesses can be entirely below or above the exterior surface plane of the housing (e.g., a hole or protruding receptacle, respectively) or partially above and partially below the exterior surface plane. In other embodiments, the compactor housing can be fabricated with holes usable to attach a rigid frame onto which one or more electric motors can be mounted. Such mounting and/or attachment can be accomplished by one or more fasteners, as known to persons of ordinary skill. Other embodiments can utilize combinations of these approaches, based on particular performance requirements, housing configurations, volume and/or mass of motors and/or reaction wheels, etc. For example, two motors could be attached to a rigid frame mounted to the housing, while a third motor could be attached via a recess fabricated as part of the housing.

Figure 9:
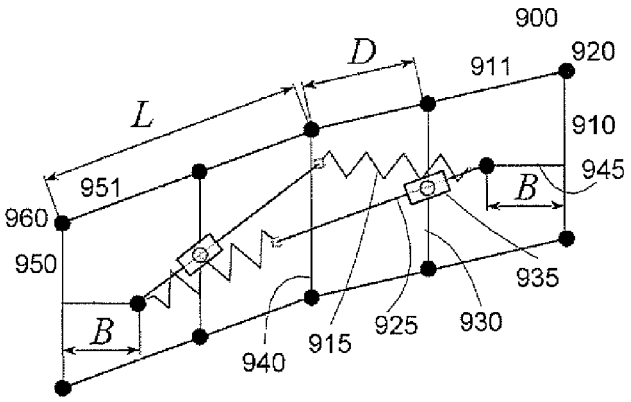
FIG. 9 is a schematic illustration of a frame for mounting a two-dimensional reaction wheel system to a percussion compactor, that can be utilized with various exemplary embodiments of the present disclosure.

FIGS. 9 and 10 illustrate another exemplary embodiment of a technique, arrangement, and/or mechanism for mounting a plurality of reaction wheels to the body of an exemplary percussion compactor. FIG. 9 shows a schematic illustration of a frame 900 that can comprise a plurality of rigid members, including a plurality of top/bottom members (e.g., members 911 and 951) of length L that can remain substantially in parallel with each other each other. Frame 900 also can comprise a plurality of vertical members (e.g., end members 910 and 950, center member 940, and mid-member 930) that also can remain substantially in parallel with each other. Frame 900 can be coupled to another body, such as a compactor, via center member 940. As shown in FIG. 9, various members are connected via angularly rotatable couplings, such as coupling 920 that connects members 910 and 911 and coupling 960 that connects members 950 and 951. The couplings can enable one half of the frame 900 (e.g., right side of fixed center member 940) to move with some degree of independence from the other half (e.g., left sift of member 940).

Frame 900 can also comprise a plurality of horizontal members, each fixedly attached to an end member (e.g., member 945 attached to member 910) on one end and further attached to a spring and a movable member on the other end (e.g., spring 915 and movable member 925 attached to member 945). In some embodiments, the length of one or more of the horizontal members can be substantially zero, such that spring and movable member can be attached directly to an end member (e.g., spring 915 and movable member 935 attached directly to end member 910). The other end of each movable member can be attached to another spring that can be further attached to the opposite fixed horizontal member. Also fixedly attached to the middle (i.e., somewhere between the ends) of each movable member can be a guide fixture (e.g., fixture 935) that also can be rotatably coupled to the nearest vertical mid-member (e.g., mid-member 930). The rotation of guide fixture 935 around its coupling to mid-member 930 can cause a change in the tension of the spring attached to the opposite end of movable member 925. The operation of the springs and movable member can facilitate the stability of a body to which frame 900 is attached, as further described in C. Schmidt-Wetekam, et al., "Design of an Arm Suspension Mechanism for an Underactuated Single Legged Hopping Robot," Proc. IEEE Int'l Conf. on Robotics & Automation 5529-34 (2011).

Figure 10A:
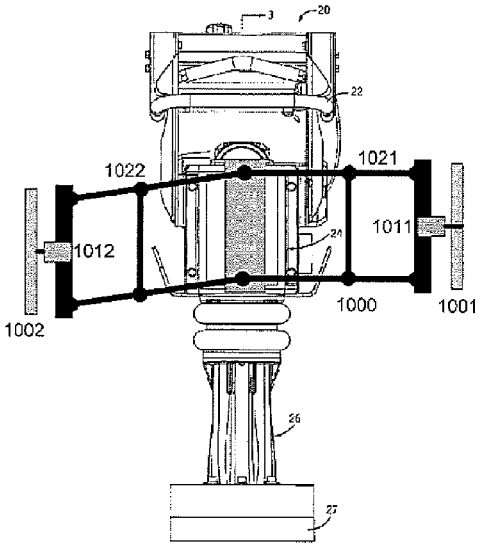
FIGS. 10*a* and 10*b* are two views of an exemplary percussion compactor that utilizes an embodiment of the frame illustrated by FIG. 9, according to one or more exemplary embodiments of the present disclosure.
Figure 10B:
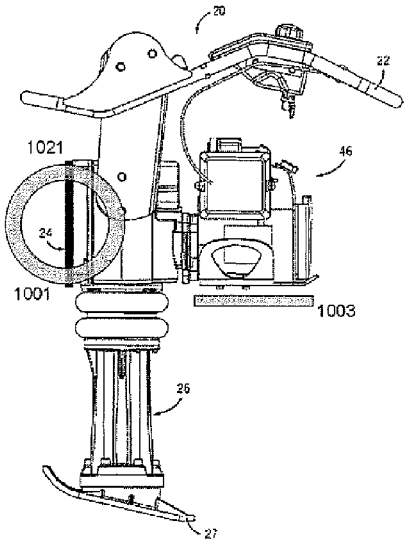

Each end member can provide a platform for mounting an electric motor coupled to a reaction wheel. FIGS. 10*a* and 10*b* illustrate an exemplary arrangement of reaction wheels on an exemplary reciprocating compactor based on the principles described above with reference to FIG. 9. FIG. 10*a* shows a front view of the exemplary percussion compactor 20, that includes a handle 22, a gearbox 24, a percussion delivery unit 26 extending downwardly from the gearbox 24, and a ground engaging plate 27. A frame 1000 can be fixedly attached to the body of the exemplary percussion compactor. For example, a middle member of frame 1000 can be attached to gearbox 24. The two halves 1021 and 1022 of frame 1000 can move relative to each other based on the principles discussed above with respect to FIG. 9, although certain components are omitted from FIG. 10*a* merely for the sake of clarity. Electric motors 1011 and 1012 can be fixedly attached to opposite end members of frame 1000 and can drive reaction wheels 1001 and 1002, respectively. The operation and control of the electric motors are described below.

FIG. 10*b* shows another view of the exemplary compactor from the side facing reaction wheel 1001. Electric motor 1011 and other details are omitted merely for the sake of clarity. FIG. 10*b* also illustrates the placement of a third reaction wheel 1003 under internal combustion engine 46, similar as discussed above with respect to FIG. 5. In the arrangement shown in FIGS. 10*a* and 10*b*, the combination of the reaction to the actuation of the reaction wheels and the coupled motion of the two halves of frame 1000 can cause the exemplary compactor to reject disturbance forces and to effect lateral movement under remote control of a user.

Control of the reaction wheels according to feedback from the IMU and input from the user (e.g., via remote control) can be accomplished in various ways. An exemplary method and/or system is illustrated by a feedback control system shown in FIG. 8. In particular, the feedback control system shown in FIG. 8 can operate according to disturbance rejection principles known to persons of ordinary skill in the art. The system can receive a control input, which can be derived from a user input via a remote control. Generally speaking, the control input can correspond to a desired positional state of the compactor. More specifically, the control input can comprise one or more parameters related to desired position, velocity, and/or acceleration of the compactor relative to the lateral (two-dimensional) surface of the working area or worksite. The control input can also comprise one or more parameters related to desired angular orientation (e.g., pitch, roll, and yaw), velocity, and/or acceleration with respect to up to three rotational axes. The control input can correspond to, or be derived from, user manipulation of one or more input devices (e.g., joystick, trackball, keypad) comprising the remote control, which are translated to commands and sent via the communication link to the remote control interface, as discussed above in relation to FIG. 6.

The control input is applied to a control processing function, which also can receive feedback from the IMU as described above. Generally speaking, the IMU feedback can correspond to an estimate of the actual positional state of the compactor. The control processing function can be wholly or partially implemented, for example, as software code and/or programmable instructions executed by processor 610 shown in FIG. 6. The control processing function can calculate a difference between the desired and measured positional states. The IMU feedback can comprise the same or different parameters than the control input; if different parameters, the control processing function can convert and/or transform one or more parameters from one or both inputs into form(s) suitable for computing a positional state difference. Based on this difference, the control processing function can determine a control actuation to be applied to the compactor body. In general, the control actuation can correspond to the reactive rotational forces necessary for the compactor body to attain the desired positional state.

Figure 8:
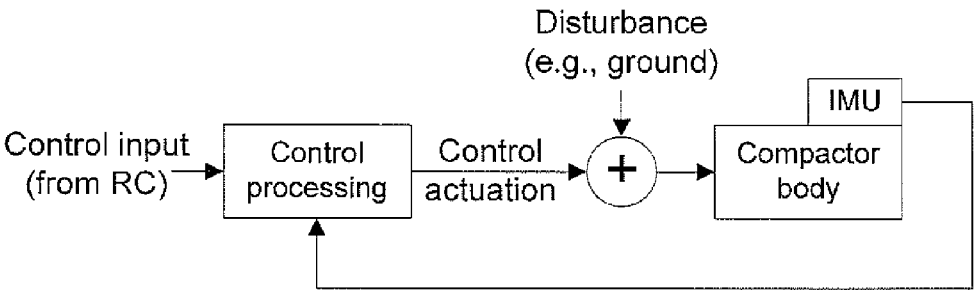
FIG. 8 is a block diagram of an exemplary feedback control system that can be utilized with various exemplary embodiments of the present disclosure.

Practically, however, the control actuation can comprise desired input currents to one or more of the electric motors. When applied via the motor controllers, such input currents can cause the motors to generate rotational forces on the reaction wheels, thereby creating the necessary reactive rotational forces in the compactor body. The control actuation can be applied to the compactor body, which can also be subject to disturbances from the environment (e.g., uneven ground, rocks, contact with persons or equipment, etc.) that can cause the actual positional state to deviate from the desired positional state. As shown in FIG. 8, the combination of the control actuation and the disturbance can be applied to the compactor body; although the two are shown as additive, this is not intended to be limiting and the two can take different forms (e.g., input current versus disturbance torque/force). The IMU can measure the effects of the control actuation and disturbance on the compactor body and can feed those measurement back to the control processing function, as discussed above. Although not shown in FIG. 8, some embodiments can comprise feedback of the operating speed (e.g., RPM) of the compactor's ICE, which corresponds to the reciprocation rate of the plate. Such feedback information can be used, for example, to account for the reciprocating (e.g., up-and-down) operating motion in determining the control actuation to be applied.

The control processing can be performed on a periodic basis, with the period or rate determined by factors including, but not limited to: expected magnitude of disturbances; desired speed of response to disturbances; the reciprocating rate of the compactor during operation; output rate of IMU measurements; responsiveness of motor controllers to change in desired current input; and moment(s) of inertia of the reaction wheels. Moreover, the control processing can be configured to respond more quickly to a disturbance than to a change in the control input, or vice versa. This configuration can depend on factors including but not limited to: magnitude and suddenness of expected disturbances; stability of the compactor in relation to such disturbances (e.g., without control processing); scenarios under which remote control is needed (e.g., lateral velocity and/or acceleration); remote control user interface requirements and/or limitations; etc.

Unless specified to the contrary herein, an electronic device and/or apparatus can be represented by a semiconductor chip, a chipset, or a (hardware) module comprising such chip or chipset; this, however, does not exclude the possibility that a functionality of a such device or apparatus, instead of being hardware implemented, be implemented as a software module such as a computer program or a computer program product comprising executable software code portions for execution or being run on a processor. Furthermore, functionality of an electronic device or apparatus can be implemented by any combination of hardware and software. More generally, a device or apparatus—whether electronic, electrical, mechanical, or a combination thereof—can be regarded as an assembly of multiple devices and/or apparatuses, whether functionally in cooperation with or independently of each other. Moreover, devices and apparatuses can be implemented in a distributed fashion throughout a system, so long as the functionality of the device or apparatus is preserved. Such and similar principles are considered as known to a skilled person.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances, including, but not limited to, e.g., data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

What is claimed is:

1. A remotely-operable percussion compactor, comprising:

a primary power source;

a plurality of electric motors, each coupled to the primary power source and attached to the body of the percussion compactor;

a plurality of reaction wheels coupled to respective ones of the electric motors;

an inertial measurement unit;

a remote control interface; and a controller configured by execution of programmable instructions to:

receive one or more commands from the remote-control interface;

receive a feedback signal from the inertial measurement unit; and set a desired operating condition for at least one of the electric motors based on at least one of: i) the one or more commands; and ii) the feedback signal.

2. The percussion compactor of claim 1, further comprising a remote-control unit capable of communicating with the remote-control interface.

3. The percussion compactor of claim 2, wherein the remote control unit comprises one or more user input devices.

4. The percussion compactor of claim 1, wherein the one or more commands pertain to at least one of the following: i) position, velocity, and/or acceleration of the compactor relative to a lateral surface of a working area; and ii) angular displacement, velocity, and/or acceleration relative to at least one rotational axis of the percussion compactor.

5. The percussion compactor of claim 1, wherein the feedback signal comprises at least one of the following: i) linear position, velocity, and/or acceleration of the compactor relative to a reference frame; and ii) angular displacement, velocity, and/or acceleration relative to at least one rotational axis of the percussion compactor.

6. The percussion compactor of claim 1, wherein:

the primary power source comprises an internal combustion engine; and the electric motors are coupled to the internal combustion engine via an electric generator.

7. The percussion compactor of claim 1, further comprising a frame attached to the body of the percussion compactor, wherein at least one or more of the electric motors are attached to the frame.

8. The percussion compactor of claim 7, wherein the frame is rigid.

9. The percussion compactor of claim 8, wherein:

the frame comprises two frame portions arranged at substantially right angles to each other;

at least one electric motor is attached to each frame portion; and both frame portions are attached to the compactor body.

10. The percussion compactor of claim 7, wherein:

the frame comprises two co-planar frame portions disposed around a center member, said center member attached to the body of the percussion compactor; and each frame portion comprises an end member disposed opposite the attachment to the center member, to which an electric motor is attached.

11. The percussion compactor of claim 10, wherein:

each end member is coupled to a spring that is further coupled by a movable member to the end member comprising the other frame portion; and the two frame portions are movable relative to each other within their common plane.

12. The percussion compactor of claim 1, wherein the body of the percussion compactor comprises one or more recesses, each recess configured to attach one of the electric motors to the body.

13. The percussion compactor of claim 1, wherein the desired operating condition for at least one of the electric motors comprises at least one of: i) input current level; ii) output rotational speed and direction; and iii) output torque magnitude and direction.

14. The percussion compactor of claim 1, wherein the plurality of electric motors comprise brushless DC motors.

15. The percussion compactor of claim 1, wherein the controller is configured to:

determine, based on the feedback signal, a disturbance relative to at least one rotational axis of the percussion compactor; and set the desired operating condition for at least one of the electric motors so as to generate a reactive force intended to at least partially counteract the disturbance.

16. The percussion compactor of claim 15, further comprising a plate configured to:

contact the ground at one or more points during operation; and apply the generated reactive force as a torque about at least one of the ground contact points.

17. The percussion compactor of claim 1, wherein the plurality of electric motors are attached to the compactor body so as at least one of their respective reaction wheels acts as a counterweight to at least a portion of the other respective reaction wheels.

* * * * *